US011447298B2

(12) United States Patent
Craig

(10) Patent No.: US 11,447,298 B2
(45) Date of Patent: Sep. 20, 2022

(54) CARRYING DEVICE

(71) Applicant: Thomas James Craig, Montclair, CA (US)

(72) Inventor: Raymond David Craig, Costa Mesa, CA (US)

( * ) Notice: Subject to any disclaimer, the term of this patent is extended or adjusted under 35 U.S.C. 154(b) by 0 days.

(21) Appl. No.: 17/073,857

(22) Filed: Oct. 19, 2020

(65) Prior Publication Data

US 2021/0114770 A1 Apr. 22, 2021

Related U.S. Application Data

(60) Provisional application No. 62/923,304, filed on Oct. 18, 2019.

(51) Int. Cl.
*B65D 25/28* (2006.01)
*B65D 25/04* (2006.01)

(52) U.S. Cl.
CPC ..... *B65D 25/2823* (2013.01); *B65D 25/04* (2013.01)

(58) Field of Classification Search
CPC ..... B65D 25/2823; B65D 25/28; B65D 25/2855; B65D 25/04; B65D 2501/24363; B65D 2501/24375; B65D 2501/24426; B65D 2501/24433; B65D 2501/24484; B65D 2525/28; B65D 2525/286; B65D 2525/287; B65D 2525/288; B65D 25/32; B65D 25/2867; B65D 33/06
USPC ..... 220/759
See application file for complete search history.

(56) References Cited

U.S. PATENT DOCUMENTS

| | | | | |
|---|---|---|---|---|
| 4,846,346 | A | 7/1989 | Kime | |
| 5,117,979 | A | 6/1992 | Brightbill | |
| D329,135 | S | 9/1992 | Embree | |
| 5,310,079 | A | 5/1994 | Sandy et al. | |
| 5,370,263 | A | 12/1994 | Brown | |
| D358,484 | S | 5/1995 | Cautereels et al. | |
| 5,445,425 | A | 8/1995 | Lyver | |
| 6,062,385 | A | 5/2000 | Cho | |
| 6,070,732 | A | 6/2000 | Chen | |
| 6,213,296 | B1 | 4/2001 | Streich et al. | |
| 6,520,513 | B2 | 2/2003 | Presley-Mays | |
| 6,910,577 | B2 | 6/2005 | O'Sullivan | |
| 2003/0000859 | A1 | 1/2003 | Straface | |
| 2003/0085552 | A1* | 5/2003 | Shapiro | B62B 3/16 280/646 |
| 2005/0023165 | A1* | 2/2005 | O'Sullivan | B25H 3/02 206/349 |
| 2012/0080432 | A1* | 4/2012 | Bensman | B25H 3/023 220/324 |
| 2014/0262885 | A1* | 9/2014 | Green | B25H 3/02 206/372 |
| 2016/0153690 | A1* | 6/2016 | Patsis | B65D 25/28 222/608 |
| 2019/0072267 | A1* | 3/2019 | Carter | A45C 15/06 |

* cited by examiner

*Primary Examiner* — Anthony D Stashick
*Assistant Examiner* — L Kmet
(74) *Attorney, Agent, or Firm* — Fox Rothschild LLP; Kari L. Barnes

(57) ABSTRACT

A carrying device is described in which a first portion and second portion are coupled together by a third portion. The first and second portion defining a free space there between such that a user can position a portion of their body for carrying of the carrying device.

20 Claims, 7 Drawing Sheets

CARRYING DEVICE

PRIORITY

The instant application claims priority to U.S. Provisional Patent Application No. 62/923,304, filed Oct. 18, 2019, which is incorporated in its entirety herein.

BACKGROUND

Carrying devices have been in use for thousands of years. They have carried water, food, tools, sand, rocks, basically anything still light enough to be lifted by a man. However, in the thousands of years that these devices have been available, there have been a paltry few innovations upon the original designs.

All known carrying devices, including buckets and all handheld portable toolboxes currently in use have 100% of the weight carried outside of the side exterior plane of the user on only one side. This causes the entire weight to be positioned far away from the center of the user, increasing the torque on a user's spine. In turn, the user of these devices will lean to the opposite side, in an effort to compensate for the weight. This causes the discs of the spinal column to grind against one another, with all the pressure of the weight being carried, which in the case of most carrying devices can exceed 40 pounds. Over time, this causes erosion of the discs, leading to back pain and back problems early in life.

SUMMARY

With the use of an ergonomically counter-weighted carrying device, the user can lift weights in excess of 40 pounds with absolutely no need to lean to one side or the other to compensate for weight, due to the weight being distributed between 3 sides of the exterior plane of the user. This lessens the grinding of the discs of the spinal column, which will lengthen the healthy life of the user's back.

FIGURES

DETAILED DESCRIPTION

Figure 1A:
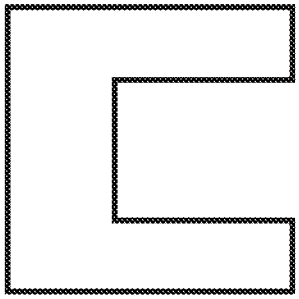
FIGS. 1A-1D illustrate exemplary top profiles of carrying devices according to embodiments described herein.

The following detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. It should be understood that the drawings are diagrammatic and schematic representations of exemplary embodiments of the invention, and are not limiting of the present invention nor are they necessarily drawn to scale. e An exemplary embodiment covers an ergonomic carrying device, which wraps around the user's body on three sides. The carrying device includes a first portion having a handle that is generally positioned to the side of a person's body and a forward and rear portion on opposing ends of the first portion that extend at least in part across the body of the user, thus surrounding one side of the user.

The configuration permits at least a portion of the weight to the rear and front of the user to be positioned inside the side exterior plane of the user, decreasing the torque on the user's spine, which more evenly distributes the overall pressure upon the body.

The empty weight distribution of the box is approximately 25-75% of the total weight being carried positioned outside (forward) the exterior plane of the front of the user's body and approximately 25-75% of the total weight being carried positioned outside (rearward) the exterior plane of the rear of the user's body and approximately 25-75% of the total weight carried located outside the right or left side of the exterior plane of the user. Preferably, approximately 15-35%, and closer to 25% of the weight is simultaneously positioned interior the side plane and exterior the front and rear planes respectively, such that approximately 30-70% and preferably closer to 50% of the weight is positioned inside the side exterior plane. The exterior planes are generally measured at the waistline of the user and are the planes parallel to the tangent of the exterior perimeter of the users body at the exterior most point (i.e. generally the front of the belly, the extreme side, and the exterior most back surface).

The described percentages may be in terms of the empty weight of the carrying device, such that for example 35% of the weight is positioned forward and rearward the front and rear plane of the user and 50% of the weight of the carrying device is exterior the side plane of the user, when the carrying device is empty. The percentages may also be in terms of the area of the footprint of the carrying device. For example, when viewed from above, the area of the carrying device forward and rearward the front and rear plane of the user may be approximately 40%, while 60% of the area is exterior the side plane of the user. The percentages may also be in terms of the carrying capacity of the carrying device, such that, for example, 25% of the carrying capacity is directly ahead or behind the user when in a normal carrying position, while 50% of the carrying capacity is the side of the user when in the normal carrying position.

In the event that the weight of the material being carried is not evenly distributed throughout the device, the use of a 2-way adjustable handle will allow the user to carry the weight evenly by changing the counterweighted center of gravity of the entire device. The handle is sufficiently long such that the user can position their hand forward or rearward and appropriately balance the carrying device along a first axis. The handle may be 2-way movable such that the device can be balanced around a second axis perpendicular to the first axis.

When weight is distributed unevenly throughout the device, the use of the adjustable handle allows the user to keep the device balanced completely, keeping it level and keeping the weight distributed between 3 sides of the exterior plane of the user.

The handle may be adjustable in a number of configurations. For example, the handle may fit within one or more detents or slits/slots within an interior portion of the carrying device such that the handle can be removed from one position and positioned forward or backwards into respective slots. The handle may be repositionably attached to the housing at a plurality of positions such that the handle moves laterally across the carrying device between an interior side and the exterior side of the carrying device in a first configuration and remain fixed at one of the plurality positions relative to the housing in a second configuration. The terminal end of the handle may be enlarged or otherwise contoured and fit within a space between the slotted portion of the carrying device, such that the handle cannot be fully removed from the carrying device and misplaced. Alternatively, the handle may be removed by lowering the handle and turning it across the handle compartment such that handles of different contours, coatings, etc. may be interchanged and replaced.

The end of the handle may also include a gear or toothed end, such that it may be generally cylindrical and roll between slotted positions.

The handle and the corresponding connection surface of the container may also be generally flat or uncontoured (without slots, teeth, or detents) but may be frictionally engaged when in contact or with the upward pressure when being carried. For example, the handle may fit within a lateral or horizontal slot where the slot is larger than the diameter of the handle, the end portion of the handle and/or the upper portion of the slot may be coated, roughened, textured, or otherwise made to frictionally engage the handle when the handle is pulled upward to lift the carrying device. When the carrying device is supported by the bottom or otherwise not through the handle, the handle may be moved away from the top surface of the slot or otherwise disengage from the frictional surface and slot along the slot to be repositioned as desired.

The handle may also be coupled to the box by cables, ropes, etc. such that the handle may be positioned along the cable. In an exemplary embodiment, a first cable may be coupled to the box on diagonally opposing sides, for example, at an interior rear end and an exterior forward end. A second cable may be positioned opposite the first one, such that the second cable crosses the first cable and is positioned on the interior front end and exterior rear end of the box. A gripping surface may be positioned around the two cables such that the user holds the gripping surface. The gripping surface may be moved along the respective cables to reposition the handle relative to the box. The handle may then be moved forward/rearward and/or interior or exterior relative to the user to support different weight distributions. The configuration of cables may be repositioned such that one cable is positioned rearward and forward on an interior side and another is positioned rearward and forward on an exterior side. In this configuration, the primary handle movement is rearward and forward relative to the user.

Other engagements of the handle are also contemplated. The handle preferably has a first configuration in which the handle is relatively immobile relative to the carrying device when the handle is supporting the weight of the carrying device. The handle has a second configuration in which the handle can move relative to the carrying device when the handle is not supporting the weight of the carrying device. The handle and/or carrying device may include a locking mechanism or other feature to secure the handle to the carrying device when in use or in a preferred position.

In an exemplary embodiment, the handle is shaped like a paddle, allowing easy gripping and more minute control forward and backward. The handle therefore may be narrower along a central portion of the handle and tapering outward toward the ends of the handle. The central portion of the handle may be generally the same diameter along a portion such as a width of a hand or just larger to suggest a middle gripping position of the handle.

In an exemplary embodiment, the handle is positioned within an exterior surface perimeter of the carrying container, such that at least a portion of the handle below the top of the container. The connection point of the handle is preferably no more than 60% of the height of the carrying device making the handle recessed, unless otherwise engineered.

The handle may be a straight handle of uniform dimension, may be a straight handle of contoured dimension, or a contoured handle. For example, the handle may have a reduced diameter interior portion. The handle may also be contoured such that the contact position with the carrying device is below a handle gripping location.

An exemplary embodiment of the box comprises an injection molded plastic. This construction material would be ideal because of its light weight and low cost. Also, the size and shape of the carrying device may be varied. For example, as seen from exemplary images provided herein, the geometric dimension of the carrying device may be generally rectangular with a rectangular contour for a portion of the user's body, the forward and rearward edges of the carrying device may be generally angled inward toward the exterior of the user's body, such that a flared interior contour is made for the user, the edges may be straight or curved, the forward and rearward portions may be, for example, any triangular or quadrilateral type shape, such as rectangular, trapezoidal, etc.

The handle of the device is preferably located across the center of gravity of the device, balanced both vertically and horizontally. If the device is empty, it will be balanced while being held in the middle position.

The carrying device may include one or more compartments of different size, allowing for the storage of multiple different materials or tools of widely differing sizes. This also allows the user the potential for many different combinations of weight distribution, placing items to be carried in the front, back, side, or between the side and either front or back, in smaller compartments. The carrying device may also include removable compartments or layers such that items may be stacked and organized within the carrying device. Lids, doors, removable panels may be used to access one or more of the compartments.

A system may also include two or more carrying devices that may be carried on opposing sides of a person. The two or more carrying devices may include opposing surfaces such that the opposing surfaces touch or directly contact when carried by the person. The contacting surface may align or support the opposing carrying device in the lateral or rotational direction, thus giving stability to the devices when being carried. For example, the opposing carrying devices may generally be mirror images of each other. The carrying devices may be symmetric around a middle axis such that the carrying device may be rotated about the longitudinal axis of the user and be used on either side of the user in a mirrored fashion.

Any combination of exemplary features of the box may be used depending on the desire of the user. For example, the contoured box may be used with a stationary handle such that the user reduces the torque on the body, but does not have to position or reposition a handle in response to or depending on the filled space of the box.

In an exemplary embodiment, the box may have a plurality of compartments. The box may include a main portion that is configured to be held outside or exterior a side plane of a user's body. The box may include a rearward and forward portions that extend from the side of the main portion and are configured to cross the side plane of a user's body and be held in front and behind the user during transport.

The box may include a fixed handle or a positionable handle. In an exemplary embodiment, the fixed handle may be secured at two or more, four, or four or more positions about the box. In an exemplary embodiment, the handle is fixed at two locations on an exterior region of the box, and is fixed at two other locations on an interior region of the box. The interior and exterior regions of the box are the portions of the box relative to the side plane of the user's body, such that an interior region are those within the side plane of a user and the exterior region are those outside of the side plane or away from the user. In an exemplary embodiment, two cables, such as heavy gauge wire, heavy gauge steel wire, cable, steel cable, rope, or other deformable structures are used to secure a gripping surface to the box. In an exemplary embodiment, a first cable is secured at forward and rearward ends of the exterior most side of the box either on the exterior most side wall or on an exterior end of the front and rear end walls of the box. A dividing or partitioned wall adjacent to the front and rear exterior corner of the box may also be used. A second cable is secured at interior (closest to the user) surfaces of the interior most edges of the box. For example, the second cable may be positioned at or adjacent to or around or near the corners of the box closest to the user's middle. The cable may be positioned on the rear interior corner of the front projection of the box that is positioned in front of a user, and on the front interior corner of the rear projection of the box that is positioned behind the user. The handle may be secured at a top portion of the box or within the box below the top surface. The gripping surface used to enclose the cables may be generally tubular to circumferentially surround the cables. The gripping surface may be ergonomically contoured. The interior and exterior surface may be different such that an interior surface is configured to grip the cables when in use and permit relative movement when not in user, while the exterior surface is configured for comfort holding.

In an exemplary embodiment, the handle is a thick exterior handle for easy access and secure grip.

In an exemplary embodiment, the box may be configured to stack above or below or in a specific relationship to one or more other boxes. For example, the top of the box may include an exterior lip with a mated portion that is configured to mate with a corresponding lip portion on a bottom side of the box. The mated surfaces may be in a projection/indentation pair, flange/edge, interlocking engagement, frictional engagement, contact surfaces, and combinations thereof. In an exemplary embodiment, the outside wall may include a beveled edge. In an exemplary embodiment, the top or bottom portion of the exterior side wall may be tapered. The profile of the top or bottom of the box may therefore be difference sized such that one box may fit within a portion of an adjacent box. For example, a box may include side walls with a slight outward taper as the box extends from the bottom to the top of the box. The bottom surface and/or bottom profile of the box may therefore be smaller than the top opening and/or top profile such that the bottom area fits within the top area enclosed by the exterior wall. The interior walls and/or lid of the box may include a lowered height relative to the exterior wall such that an exterior edge of the box defines a lip or ledge that acts as an exterior boarder or retainer for a bottom of a box positioned on top of a lower box. In an exemplary embodiment, the outer wall may be 0.1 inch to 2 inches taller than the interior or top portion of the box.

In an exemplary embodiment, the handle of the box may be stowable and/or removable. For example, a handle may project over a top surface and/or lid of the box during use. The handle may be removable and positioned within the box during storage. The handle may therefore be positioned out of the way for stackability. A bottom of the box may also or alternatively be contoured to fit or accommodate the projection of the handle when one box is stack on top of another box. The handle may also be retained or positionable (whether in normal use or in a stowed configuration) within an interior cavity of the box. In this case, the handle may be removed from interaction from another box. The box may also be configured such that the exterior of the box may fit within the interior of another box. For example, compartments may be separated by removable inserts. The exterior walls may be tapered such that a lower portion of a box may fit within an upper portion of a box. The box may be more collapsible in the stacked configuration when the inserts are removed.

In an exemplary embodiment, the box may be configured to be waterproof and/or drainable. The box may therefore include apertures on a lower or bottom portion thereof. In an exemplary embodiment, the apertures may include plugs or valves. For example, an aperture may support a plug therein such that retained objects are not accidently dropped through a bottom of the box. However, if filled with liquid, the box may be drained by removing the plug and allowing the liquid to pass there through. The bottom of the box may also include indentations that create channels in the bottom of the box. The channels may be used to collect liquid within the box and direct the liquid to one or more exit apertures. A bottom surface and/or bottom portion of an exterior side wall may include a spout. The spout may include a valve that can be activated by a user. When activated, the spout may permit passage from the interior cavity of the box to an exterior side of the box.

Figure 1B:
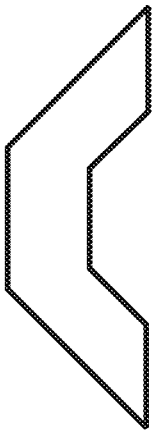
Figure 1C:
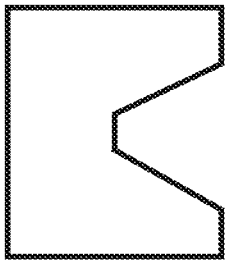
Figure 1D:
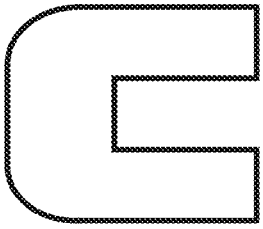

FIGS. 1A-1D illustrate exemplary embodiments of a box having three portions creating an interior positional cavity for a portion of a body of a user. Each configuration includes a side portion, a front portion, and a rear portion. The side portion extends between the front portion and the back portion. A space or gap is created between the front portion and the back portion defining free space in which a user may be positioned to carry the box. As seen in FIG. 1A, the front portion and back portion may extend from the side portion in the same direction and define generally parallel projections. The front portion and back portion may be generally equidistantly separated along the length of either or both of the front and back portion. As seen in FIG. 1B, the front portion and back portion may extend from the same side of the side portion but extend outwardly away from each other as the front and end portions extend away from the side portion. The front portion and back portion may therefore define an outwardly tapered separation along the length of the front or back portions as the portions are traversed from the side portion to an exterior end thereof. The front portion may extend outward from the side portion and define generally parallel front and back edges; similarly the back portion may extend outward from the side portion and define generally parallel front and back edges. The front portion and back portion may define an extension of generally constant width along its length. FIG. 1C illustrates an exemplary embodiment in which the outer perimeter is generally that of FIG. 1A being generally rectangular, while the interior perimeter is generally that of FIG. 1B in which the interior perimeter is outwardly tapered from the side portion to the exterior, terminal ends of the front and back portions. The width of the front and back portions may therefore be greater adjacent the side portion and may taper to a smaller width near the exterior, terminal ends of the front and back portions. FIG. 1D illustrates an exemplary embodiment in which the corners of the profile are softened and curved about the transition portions. FIG. 1C is one example in which the different configurations may be combined including a combination of FIGS. 1A and 1B. Any recombination of features may be included and remain within the scope of the instant disclosure.

FIG. 1 illustrates an exemplary box according to embodiments described herein. As shown, the exemplary box 200 may include a first portion 224 positioned forward of a plane 218 corresponding to the front of a user's body, space 202, and a back portion 206 positioned rearward of a plane 220 corresponding to the back of the user's body, space 204. The box may include a third portion 214 that extends between the first portion 224 and second portion 206. The third portion 214 may be positioned exterior or on a lateral side of a plane 208 corresponding to a user's side of the body, space 210. The relative positions of the box, including the first portion, second portion, and third portion are relative to a user in a carrying position. In an exemplary embodiment, the box includes free space between the first portion and the second portion such that a portion of the user's body can be positioned in the free space during the carrying position.

In an exemplary embodiment, the free space permits the positioning of the box about a portion of the user. The front portion and back portion permit the distribution of weight closer to the user's center of gravity. Conventional carrying devices position the full weight of the box on an exterior lateral side of a user, i.e. outside of plane 208 in space 210. Exemplary embodiments described herein permit the central of gravity of the support weight in the box to be moved toward the center of gravity of the user, for example, such as between the distance 212.

Exemplary embodiments of the box include a handle 216. The handle can be configured to move within the third portion as indicated by arrows 222, such as toward or away from the free space defined between the first portion and second portion.

Figure 3:
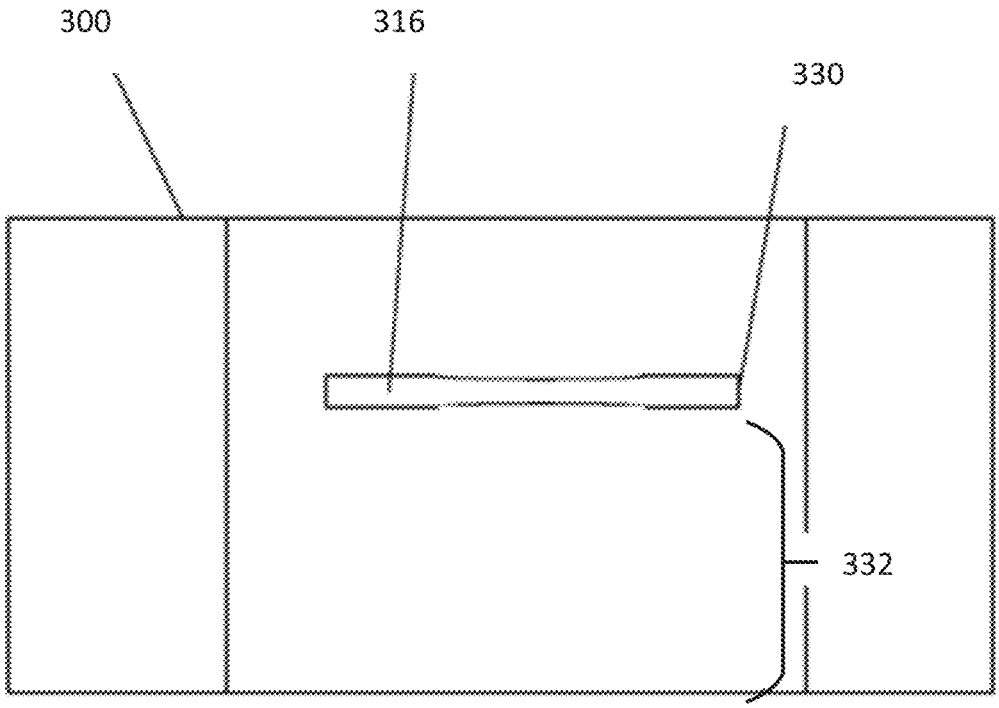
FIG. 3 illustrates an exemplary side view of a carrying device according to embodiments described herein with a partial view into the interior of the device.

FIG. 3 illustrates an exemplary embodiment in which handle 316 is positioned in an interior cavity of the box 300. The handle 316 may have opposing attachment ends 330. The handle may be positioned a distance 332 from a bottom of the box, where the distance is less than a vertical height of the exterior wall of the box.

Figure 4A:
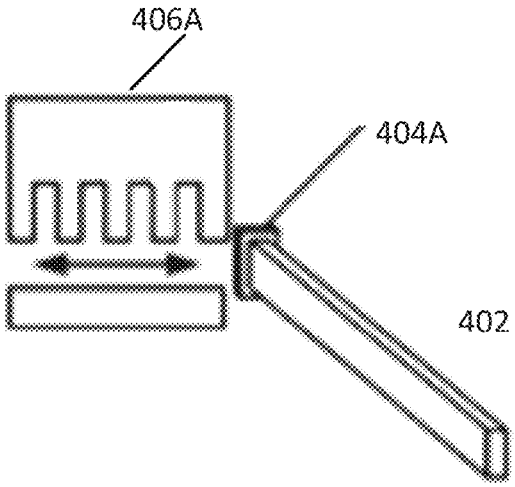
FIGS. 4A-4B illustrate exemplary handle attachment configurations according to embodiments described herein.
Figure 4B:
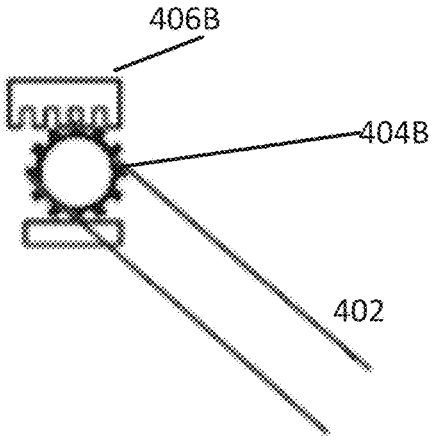

FIGS. 4A-4B illustrate exemplary embodiments of a portion of a handle 402 having different attachment ends 330. Exemplary embodiments of an attachment end may permit the relative movement of the handle for positioning in a desired location for carrying, but retains the relative position during the carrying action. For example, the weight of the box during carrying may create a frictional engagement to retain the handle in a set location during the carrying action. However, once the weight is relieved, such as when the box is positioned on the ground, the handle may be moved relative to an exterior edge of the box. As illustrated in FIG. 4A, a handle 402 may include a shaped terminal end 404A that engaged with a retainer 406A. As shown, the handle may include a cross sectional shape that may be inserted into indentations within the retainer 406A for selection positioning at discrete positions of the retainer. FIG. 4B illustrates an embodiment in which a continuous selection of positions may be made. The retainer may include a similar indentation for receiving a terminal end portion of the handle. The retainer may include smaller indentations for receiving only a portion of the handle instead of an entire cross sectional shape. The terminal end portion 404B of the handle may include projections, such as in a geared configuration for mating with the retainer 406B.

Figure 5A:
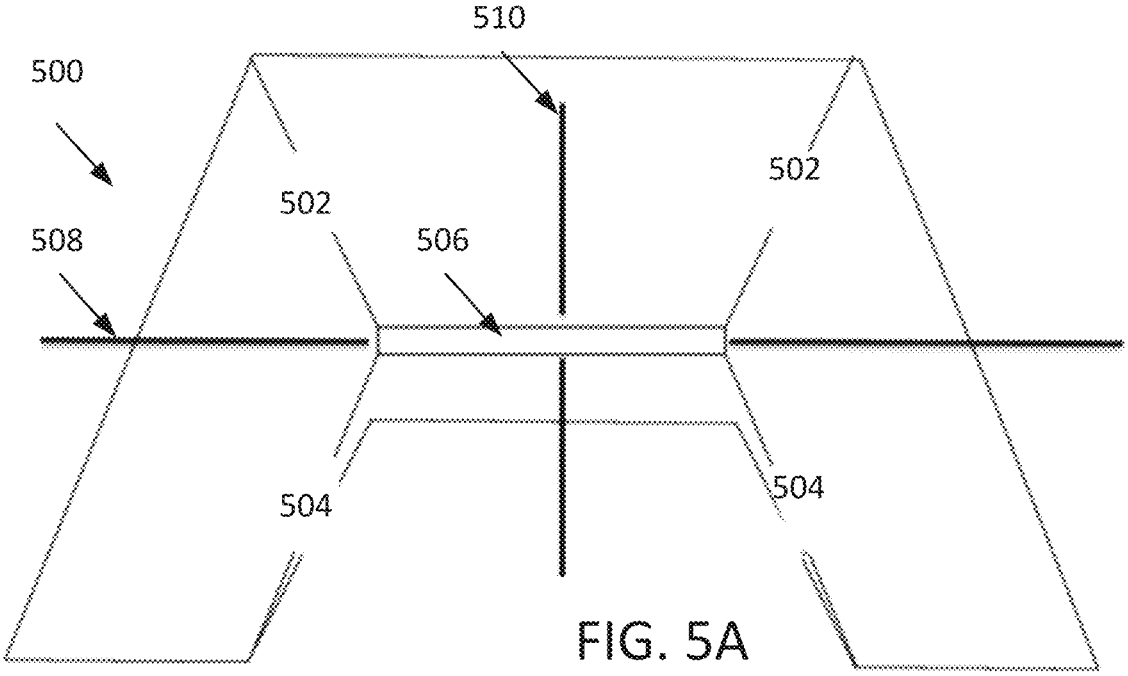
FIGS. 5A-5B illustrate exemplary handle attachment configurations according to embodiments described herein.
Figure 5B:
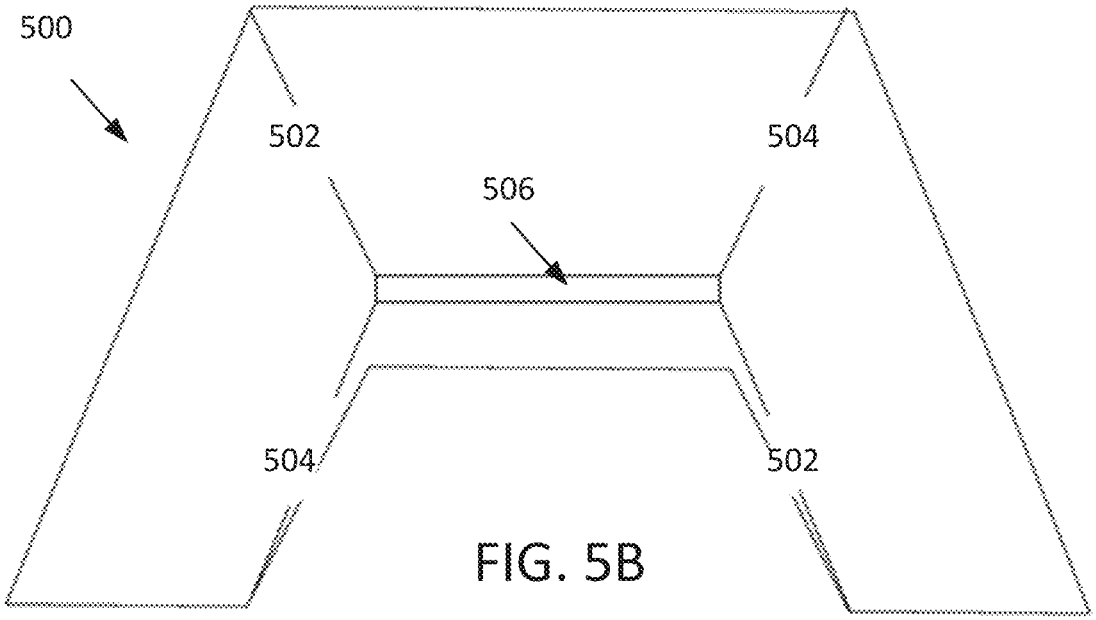

FIGS. 5A-5B illustrate an exemplary embodiment for a handle 506 in which the handle may be coupled to the box 500 through one or more cords. As illustrated, two cords are used. FIG. 5A illustrates an embodiment in which a first cord 502 coupled to an exterior side of the same side of the box at both ends of the cord, and a second cord 504 coupled to an interior side on the same side of the box at both ends of the cord. The cords 502, 504 extending through the handle 506 may define an axis 508 in which the handle may move along by sliding the handle along the cord in a forward or rearward direction. The handle may therefore be moved forward or rearward of the middle of the box 510. FIG. 5B illustrates an example in which the cords cross over to opposing, diagonal sides of the box, such that a first cord 502 is coupled to a first end of the box on an exterior side and a second end of the box on an interior side, while the second cord 504 attaches to the second end of the box on the exterior side and the first end of the box on the interior side.

Figure 6:
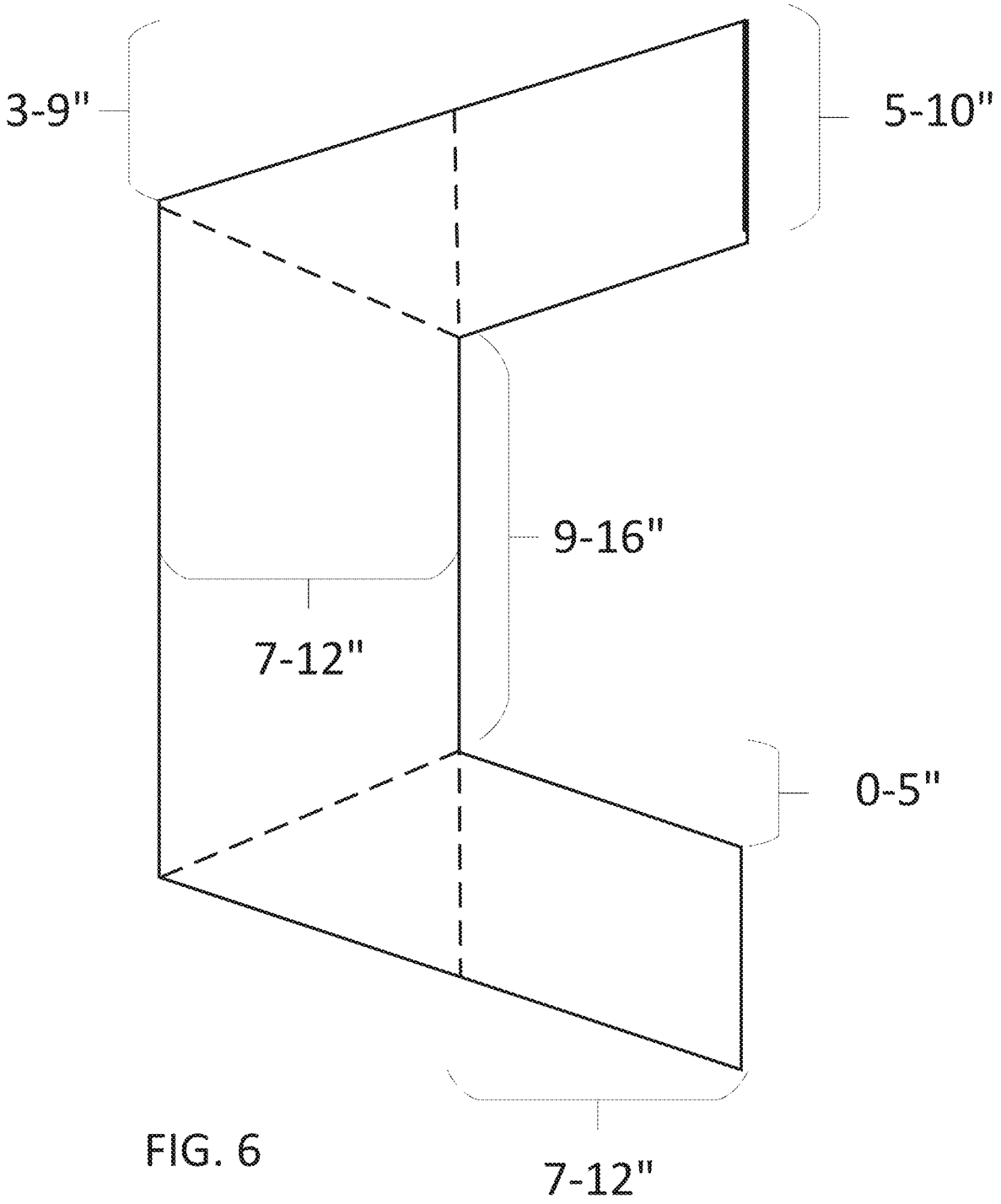
FIG. 6 illustrates an exemplary top plan view of an exemplary embodiment with exemplary dimensional ranges.

FIG. 6 illustrates an exemplary embodiment of the box including exemplary dimensional ranges for the first portion, the second portion, and third portion of the box. The hard lines represent exterior peripheral edges of the box defining the first, second, and third portions. The interior dashed lines indicate exemplary interior cavities or walls that may be permanently, or removably inserted into the box. In an exemplary embodiment, the interior side wall and/or bottom wall of the box may include rails that can support and position inserted planar dividers. Different positions of rails may be included on an interior surface of the box to permit selective, removable, and configurable positioning of dividers therein.

Figure 7:
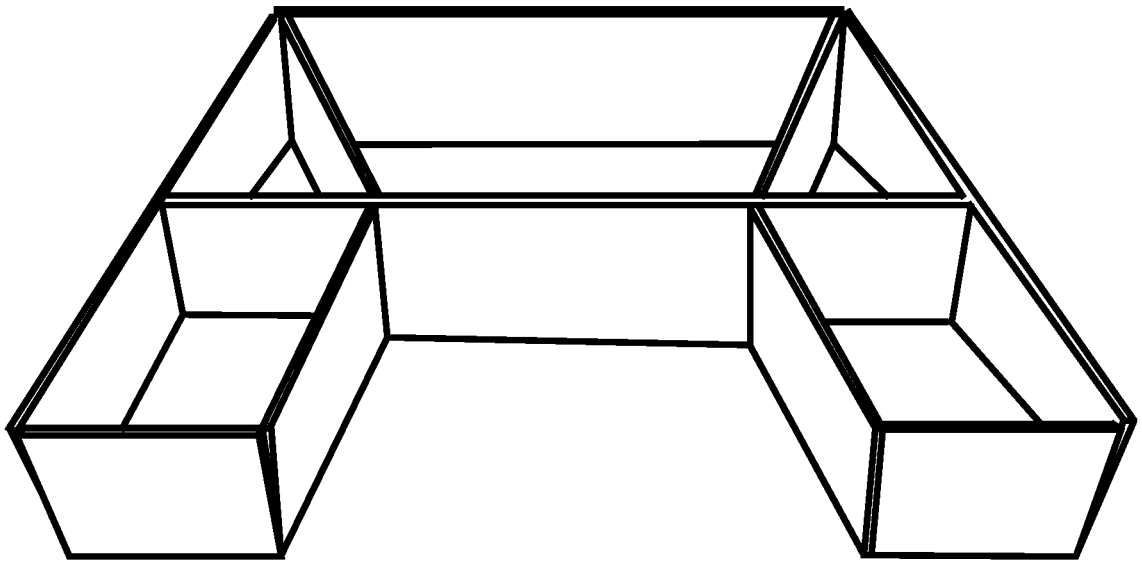
FIG. 7 illustrates a perspective view of the interior of an exemplary carrying device according to embodiments described herein.

FIG. 7 illustrates an exemplary box according to embodiments described herein as seen in perspective to illustrate the depth of the box and exemplary interior walls to define different compartments therein.

Figure 2:
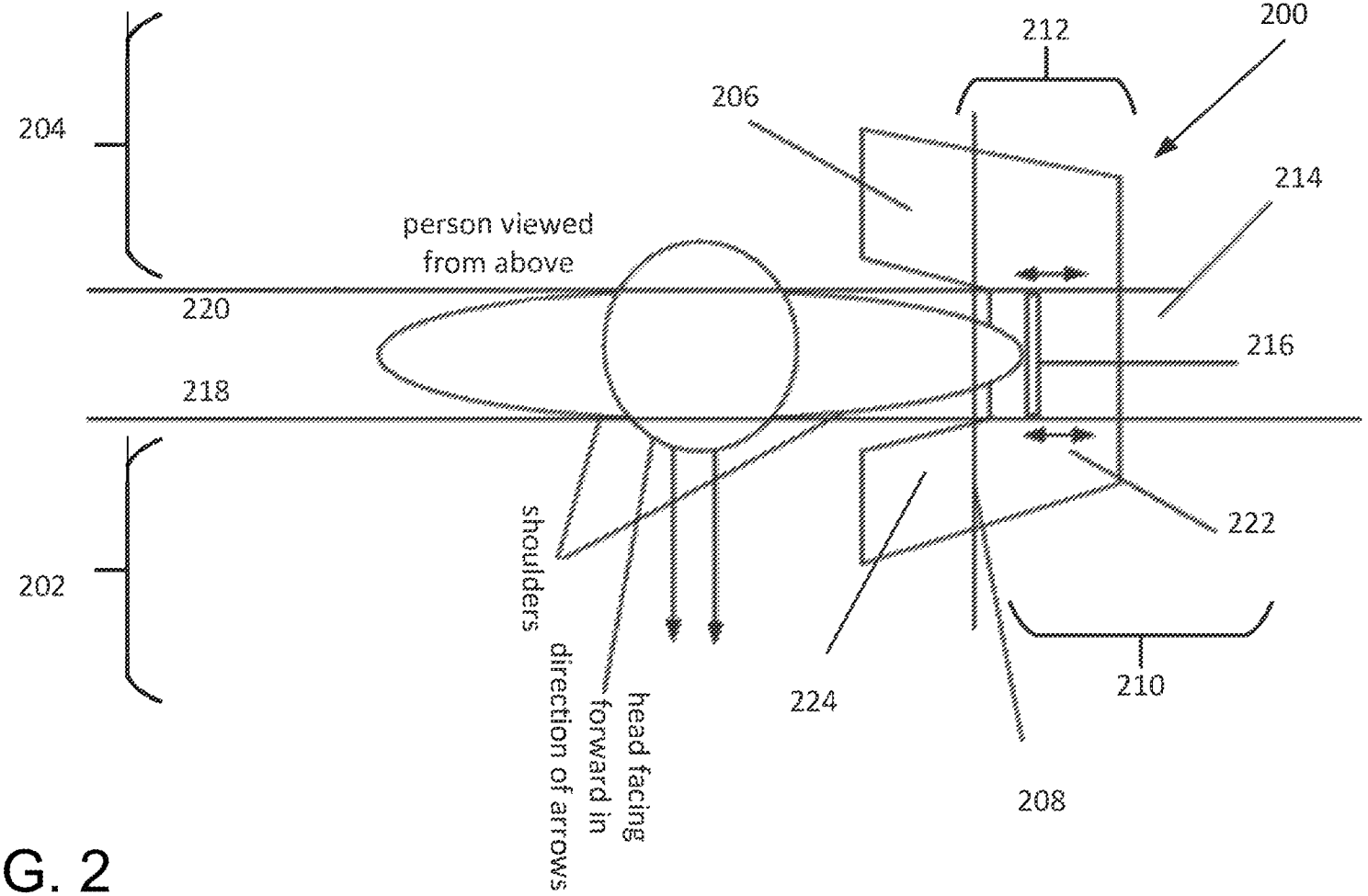
FIG. 2 illustrates an exemplary user with a carrying device according to embodiments described herein from a top elevation view.
Figure 8A:
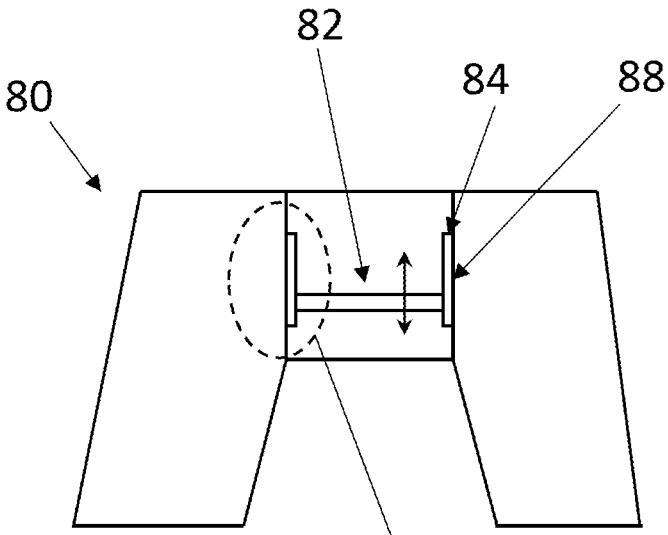
FIG. 8A illustrates a top view of an exemplary carrying device as seen in FIG. 2 with the handle configuration as illustrated in FIG. 4A.
Figure 8B:
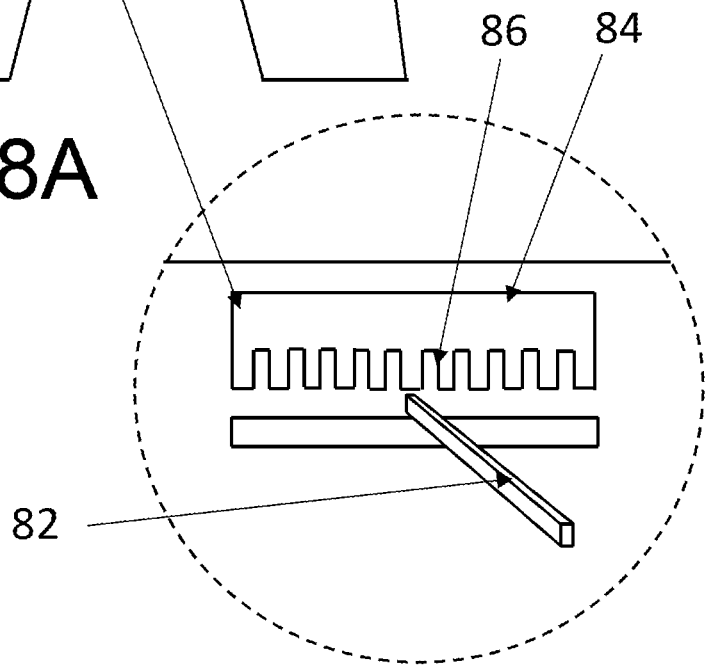
FIG. 8B illustrates a component view of the component of FIG. 8A.

FIG. 8A illustrates a top view of an exemplary carrying device 80 as seen in FIG. 2 with the handle configuration as illustrated in FIG. 4A; FIG. 8B illustrates a component view of the component of FIG. 8A. The handle 82 may be adjustable in a number of configurations. For example, the handle 82 may fit within one or more detents or slits/slots 86 within an interior portion of the carrying device 84 such that the handle can be removed from one position and positioned forward or backwards into respective slots 86. The terminal end of the handle may be enlarged or otherwise contoured and fit within a space 88 between the slotted portion of the carrying device 84, such that the handle cannot be fully removed from the carrying device and misplaced. Alternatively, the handle may be removed by lowering the handle and turning it across the handle compartment such that handles of different contours, coatings, etc. may be interchanged and replaced.

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

Conditional language used herein, such as, among others, "can," "could," "might," "may," "e.g.," and the like, unless specifically stated otherwise, or otherwise understood within the context as used, is generally intended to convey that certain embodiments include certain features, elements and/or states. However, such language also includes embodiments in which the feature, element or state is not present as well. Thus, such conditional language is not generally intended to imply that features, elements and/or states are in any way required for one or more embodiments or that one or more embodiments necessarily exclude components not described by another embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item.

As used herein, the terms "about," "substantially," or "approximately" for any numerical values, ranges, shapes, distances, relative relationships, etc. indicate a suitable dimensional tolerance that allows the part or collection of components to function for its intended purpose as described herein. Numerical ranges may also be provided herein. Unless otherwise indicated, each range is intended to include the endpoints, and any quantity within the provided range. Therefore, a range of 2-4, includes 2, 3, 4, and any subdivision between 2 and 4, such as 2.1, 2.01, and 2.001. The range also encompasses any combination of ranges, such that 2-4 includes 2-3 and 3-4.

Exemplary embodiments described herein are intended to move the center of gravity of the box toward the user. Exemplary embodiments may therefore include extensions of the box that project in front of and/or behind the user. Other systems may include contoured side walls or cut outs of previously rectangular boxes. These systems do not achieve the same objective of permitting the user to carry a box in a more upright position by moving the center of gravity to within the frontal profile of the user.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

The invention claimed is:

1. A carrying device, comprising:

a housing having: a bottom and an exterior wall extending from the bottom and defining an outer perimeter of the carrying device, wherein the carrying device is configured to be carried on a carrying side of a user so that the exterior wall has an interior side toward the user and an exterior side away from the user;

and a handle repositionably attached to the housing at a plurality of positions such that the handle moves laterally across the carrying device between the interior wall and the exterior wall in a first configuration and remain fixed at one of the plurality positions relative to the housing in a second configuration, wherein the carrying device has a first portion, a second portion, and a third portion, wherein the exterior wall is contoured such that the first portion is configured to be positioned directly in front of the user, the second portion is configured to be positioned directly behind the user, and the third portion is configured to connect the first portion to the second portion, where a relative position of the first portion, the second portion, and the third portion are positioned to create a free space between the first portion and the second portion such that a portion of the user can be positioned in the free space when the user is carrying the carrying device, wherein the exterior wall is contoured to provides an empty weight distribution of the carrying device of 30 percent to 70 percent of an empty weight of the carrying device positioned on one side of a side plane and 70 percent to 30 percent of the empty weight of the carrying device is positioned on an opposite side of the side plane of the carrying device where the side plane is oriented along on a tangent of an exterior perimeter of the user at the waistline on the carrying side of a user when the user is carrying the carrying device.

2. The carrying device of claim 1, wherein the exterior wall and bottom create an interior cavity for holding objects, and the contoured exterior wall is configured such that when a user is carrying the carry device, a portion of the user's body is positioned within an indentation created by the contoured exterior wall.

3. The carrying device of claim 2, wherein the bottom or a lower portion of the exterior wall or a combination thereof includes a hole configured to allow fluid flow from the interior cavity to outside of the carrying device.

4. A system comprising, the carrying device of claim 2, and a handle.

5. The system of claim 4, wherein the second configuration is an in use configuration when an outside force is applied to the handle to support the carrying device, and the handle is coupled to the carrying device such that a position of the handle relative to the exterior wall in the second configuration is selectable between the plurality of positions that is selected by movement of the handle in the first configuration.

6. The system of claim 5, wherein the handle comprises an end and the carrying device comprises a retaining feature, wherein the end and retaining feature included mated surface where at least a portion of the end fits within the retaining feature.

7. The system of claim 6, wherein the handle is positioned within the interior cavity, below a maximum vertical height of the exterior wall.

8. A carrying device, comprising:

a housing defining:

a first portion, a second portion, and a third portion extending between the first portion and second portion, wherein the housing of the first portion, second portion, and third portion create an interior cavity of the carrying device; and a handle having a first attachment end and a second attachment end, the handle configured to movably couple in a first, non-carrying configuration and in a fixed couple relative to the housing in a second, carrying configuration so that the handle retains a relative position to the housing in a carrying position, a combination of the movably couple and fixed couple arrangement of the handle to the housing is configured to permit the first attachment end of the handle and the second attachment end of the handle to be positioned in a first relative position to the housing in a first fixed carrying position and a second relative position to the housing in a second fixed carrying position so that the handle may be is selectively positioned during use, the first fixed carrying position and the second fixed carrying position are different and positioned laterally across the carrying device from each other, wherein the carrying device has a longitudinal axis oriented generally between the first portion and the second portion, and a lateral axis perpendicular to the longitudinal axis across the third portion.

9. The carrying device of claim 8, wherein the first portion, the second portion, and the third portion creating the interior cavity is subdivided to define more than one cavity for carrying objects.

10. The carrying device of claim 8, wherein the interior cavity is defined by an interior edge of a section of the first portion, a section of the second portion, and a section of the third portion and an exterior edge of the section of the first portion, the section of the second portion, and the section of the third portion, and a minimum interior width distance measured from the interior edge to the exterior edge of the interior cavity along any section of the first portion is greater than a maximum interior width distance from the interior edge to the exterior edge along any section of the third portion, and a minimum interior width distance measured from the interior edge to the exterior edge of the interior cavity along any section of the second portion is greater than a maximum interior width distance from the interior edge to the exterior edge along any section of the third portion.

11. The carrying device of claim 8, wherein the interior cavity is defined along one edge by an interior edge of a section of the first portion, a section of the second portion, and a section of the third portion, wherein the interior edge is planar along a portion of the first portion and along a portion of the second portion and at least a portion of the interior edge along a portion of the third portion is inwardly offset from a plane containing the portion of the first portion and the portion of the second portion, wherein the offset is 7 inches to 12 inches.

12. The carrying device of claim 8, wherein the interior cavity is defined along one edge by an interior edge of a section of the first portion, a section of the second portion, and a section of the third portion, wherein the interior edge along the section of the third portion is offset toward an interior of the carrying device relative to at least a portion of the interior edge along a section of the first portion and at least a portion of the interior edge along a section of the second portion, wherein the offset provides an empty weight distribution of the carrying device of 30 percent to 70 percent of an empty weight of the carrying device is positioned on one side of a side plane of the carrying device and 70 percent to 30 percent of the empty weight of the carrying device is positioned on an opposite side of the side plane of the carrying device where the side plane is oriented along a section of the interior edge along a portion of the third portion.

13. The carrying device of claim 1, wherein the handle is coupled to the housing at a first attachment location between the handle and the carrying device and a second attachment location between the handle and the carrying device, and the first attachment location and the second attachment location are configured to be relocated relative to the housing for each of the plurality of positions.

14. The carrying device of claim 1, wherein the housing further comprises a retaining feature and the retaining feature and the handle define mated surfaces wherein the mated surfaces on the handle are at a first attachment end and a second attachment end, and when the mated surfaces are engaged between the retaining feature and the handle the first attachment end and the second attachment end of the handle are fixed relative to the housing and when the mated surfaces are not engaged the first attachment end and the second attachment end of the handle are moveable relative to the housing.

15. The carrying device of claim 14, wherein the mated surfaces are engaged when the handle is used to lift a weight of the carrying device, and the mated surfaces comprise a toothed projection or a slotted indentation.

16. The system of claim 5, wherein the handle is configured such that the handle moves laterally across the carrying device in the first configuration.

17. A carrying device, comprising:

a housing defining:

a first portion, a second portion, and a third portion extending between the first portion and second portion, wherein the housing of the first portion, second portion, and third portion create an interior cavity of the carrying device; and a handle having a first end and a second end, the handle couples to the housing at an attachment location, wherein the coupling between the handle to the housing permits the attachment location to move in a first, non-carrying configuration and fixed relative to the housing in a second, carrying configuration so that the handle retains a relative position to the housing in a carrying position that may be selectively positioned in different attachment locations across the carrying device in the second, carrying configuration.

18. The carrying device of claim 17, wherein the interior cavity is defined along one edge by an interior edge of a section of the first portion, a section of the second portion, and a section of the third portion, wherein the interior edge along the section of the third portion is offset toward an interior of the carrying device relative to at least a portion of the interior edge along a section of the first portion and at least a portion of the interior edge along a section of the second portion, wherein the offset provides an empty weight distribution of the carrying device of 30 percent to 70 percent of an empty weight of the carrying device is positioned on one side of a side plane of the carrying device and 70 percent to 30 percent of the empty weight of the carrying device is positioned on an opposite side of the side plane of the carrying device where the side plane is oriented along a section of the interior edge along a portion of the third portion.

19. The carrying device of claim 17, wherein the handle is coupled to the housing at the attachment location and a second attachment location, wherein the attachment location is between the housing and a first end of the handle and the second attachment location is between the housing and a second end of the handle, and the attachment location and the second attachment location are configured to move relative to the housing.

20. The carrying device of claim 17, wherein the housing further comprises a retaining feature and the retaining feature and the handle define mated surfaces, and when the mated surfaces are engaged the attachment location is fixed relative to the housing and when the mated surfaces are not engaged the attachment location is moveable relative to the housing.

* * * * *